US007082802B2

(12) United States Patent
Reed

(10) Patent No.: US 7,082,802 B2
(45) Date of Patent: Aug. 1, 2006

(54) METHOD OF CREATING INTEGRAL SPACERS IN REINFORCING BARS EMPLOYED IN THE FABRICATION OF CONCRETE PIPE

(75) Inventor: Allen J. Reed, Levittown, PA (US)

(73) Assignee: Oldcastle Precast, Inc., Rehoboth, MA (US)

( * ) Notice: Subject to any disclaimer, the term of this patent is extended or adjusted under 35 U.S.C. 154(b) by 0 days.

(21) Appl. No.: 10/851,467

(22) Filed: May 21, 2004

(65) Prior Publication Data

US 2005/0257850 A1 Nov. 24, 2005

(51) Int. Cl.
*B21D 31/04* (2006.01)
*B21D 47/00* (2006.01)

(52) U.S. Cl. ..... 72/302; 140/107

(58) Field of Classification Search ..... 72/301, 72/302, 386, 385, 389.6, 390.7; 149/107, 149/106, 105
See application file for complete search history.

(56) References Cited

U.S. PATENT DOCUMENTS

| | | | | |
|---|---|---|---|---|
| 1,720,183 | A * | 7/1929 | Parmer | 72/390.6 |
| 2,650,637 | A * | 9/1953 | Paxson | 72/389.6 |
| 3,192,962 | A * | 7/1965 | First et al. | 140/107 |
| 3,561,501 | A * | 2/1971 | Fauteux | 140/107 |
| 4,515,004 | A * | 5/1985 | Jaenson | 72/388 |
| 5,724,852 | A * | 3/1998 | Lee | 72/389.6 |

* cited by examiner

*Primary Examiner*—Daniel C. Crane
(74) *Attorney, Agent, or Firm*—Sheridan Ross P.C.

(57) ABSTRACT

The present invention relates to an apparatus and method for selectively producing a deformation in a reinforcing frame employed in the fabrication of concrete pipes or other similar construction materials. The deformation maintains the frame in the proper predetermined location inside the concrete form during fabrication to thus produce a concrete pipe with optimum structural properties.

9 Claims, 5 Drawing Sheets

Fig. 7
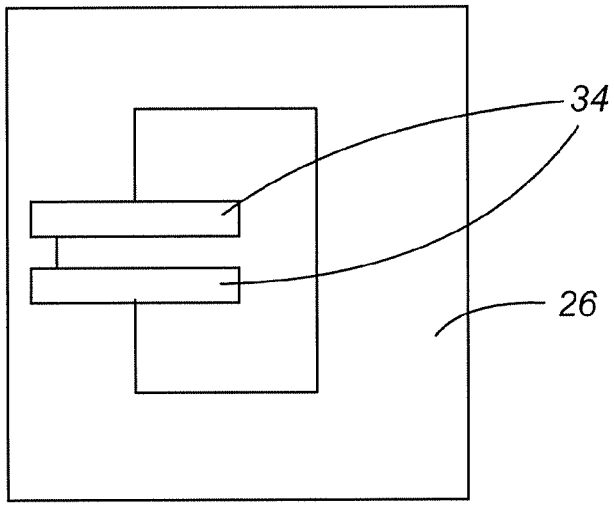
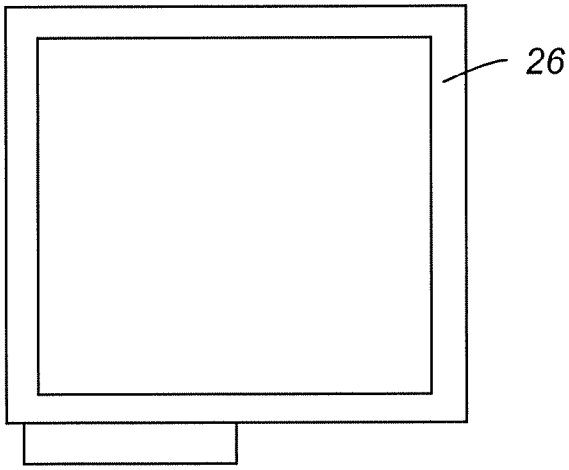
Fig. 8
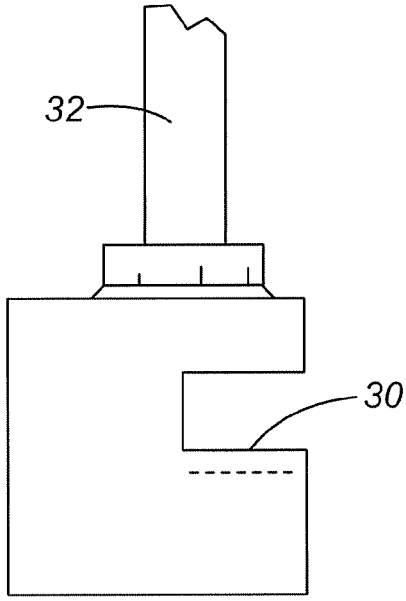
Fig. 9

METHOD OF CREATING INTEGRAL SPACERS IN REINFORCING BARS EMPLOYED IN THE FABRICATION OF CONCRETE PIPE

FIELD OF THE INVENTION

The present invention relates generally to a device for selectively deforming reinforcing frames that are employed in the construction of concrete pipes. More specifically, one embodiment of the present invention selectively deforms longitudinal members of the reinforcing frame, thus ensuring that the frame maintains a predetermined location within a concrete pipe forming mold during fabrication.

BACKGROUND OF THE INVENTION

Concrete pipes are employed in various civil engineering and architectural applications, such as culverts and building supports. Concrete pipes are well suited for these applications since they are relatively light and strong in compression. Generally, concrete pipes are constructed by placing a reinforcing metal frame inside a mold adapted to receive and cure concrete of a predetermined composition. The resultant concrete pipe includes an outside surface and an inside surface with the reinforcing frame therebetween. One drawback of concrete pipe construction is that the placement of the metal frame relative to the outside and inside surfaces of the pipe may be altered as a result of the forming process. More specifically, it is desirable to maintain the radial location of the metal frame with respect to the internal diameter and outer diameter of the finished concrete pipe, wherein the theoretical structural behavior of the finished product is well characterized. For example, if the metal frame is offset in the form during fabrication, the finished pipe will have significantly different material properties in various areas of the pipe, which may lead to localized buckling of the frame or cracking of the concrete.

Thus, there is a long felt need in the field of concrete pipe fabrication to ensure that the reinforcing material used therein is located in the proper predetermined location subsequent to the forming operation, thus ensuring that the finished product behaves as expected. The following disclosure describes a device for selectively deforming the reinforcing frame to provide integral spacers that are adapted to engage the molding form to thus maintain the radial location of the frame therein.

SUMMARY OF THE INVENTION

It is thus one aspect of the present invention to provide a device that selectively alters the shape of a reinforcing metal frame thereby providing integral spacers that maintain the frame's placement inside a concrete mold during pipe fabrication. More specifically, one embodiment of the present invention selectively deforms longitudinal members of the reinforcing frame thus severely limiting radial motion of the entire frame when it is placed in the mold so it remains in an optimum location during concrete pipe fabrication. The present invention also easily moves from various locations on the reinforcing frame to deform selected areas thereon.

It is another aspect of the present invention to provide a device that selectively produces integral spacers of predetermined shapes in the reinforcing frame. More specifically, one embodiment of the present invention produces v-shaped deformations at predetermined locations of the reinforcing frame, such as the longitudinal members. As it will be appreciated by one skilled in the art, deformation of a reinforcing frame may be accomplished in other ways, for example by impacting the frame with a hammer or using other rod techniques. However, it is desirable to ensure that the resultant diameter of the frame at the location of the integral spacer is substantially equal to the inner diameter of the mold. Thus, it is one aspect of the present invention to ensure that all spacers are created substantially in a the way taught herein to ensure uniformity throughout the frame, and thus aid in the prediction of structural behavior of the finished product.

It is another aspect of the present invention to provide a device that quickly adjusts to engage various locations on the frame. More specifically, in one embodiment of the present invention a pulling arm is employed that selectively engages a longitudinal member of the frame and deforms it to create an integral spacer. The device is then moved to a new location to create another integral spacer, thus reducing the time of altering the frame. Additional time savings are also realized in the fact that after the concrete pipe is completed, a reduced number will be discarded because of noncompliance to fabrication specifications.

It is still yet another aspect of the present invention to provide a device that is constructed from common parts and materials, thus reducing manufacturing costs. For example, one embodiment of the present invention employs a common foot-activated pneumatic motor drive mechanism for cycling the pulling arm. In addition, other components of the present invention are constructed from steel plates and beams.

It is yet another aspect of the present invention to provide a device that is safe to operate. More specifically, the pulling arm of one embodiment of the present invention is actuated by a foot pedal, wherein a worker will be situated a safe distance from the deformation operation. Operations that use extreme force to bend metal are often dangerous. If, for example, the deformation mechanism pulls a frame member too intensely, wires used to interconnect transverse members to the longitudinal members of the frame may become dislodged and perhaps break, thus throwing bits of metal into the general vicinity. The present invention allows the users of the device to stand away from the deformation operation, or perhaps behind a barrier, during operation of the device. In addition, other means such as radio-controlled devices maybe used to actuate the pulling arm to ensure even greater safety.

Thus, it is one aspect of the present invention to provide a method for creating an integral spacer in a metallic frame for reinforced concrete pipe, comprising the steps of:

providing a substantially cylindrical shaped metallic frame comprising a plurality of vertically oriented reinforcing members and a plurality of horizontally oriented reinforcing members to define an apparatus with a first length and a first diameter;

positioning said substantially cylindrical shaped metallic frame against a support member;

positioning at least one of said vertically oriented reinforcing members proximate to a pulling arm;

securing said at least one vertically oriented reinforcing member to said pulling arm; and pulling said vertically oriented reinforcing member in a direction substantially away from said cylindrical shaped metal frame with sufficient force to permanently deflect said at least one of said vertically oriented reinforcing member, wherein said substantially cylindrical shaped metal frame has a greater diameter at the location where said vertically oriented reinforcing member has been deflected.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these embodiments.

FIG. 7 is a front elevation view of a housing of one embodiment of the present invention;

FIG. 8 is a bottom plan view of a housing of one embodiment of the present invention; and FIG. 9 is a top plan view of a pulling arm of one embodiment of the present invention.

Figure 1:
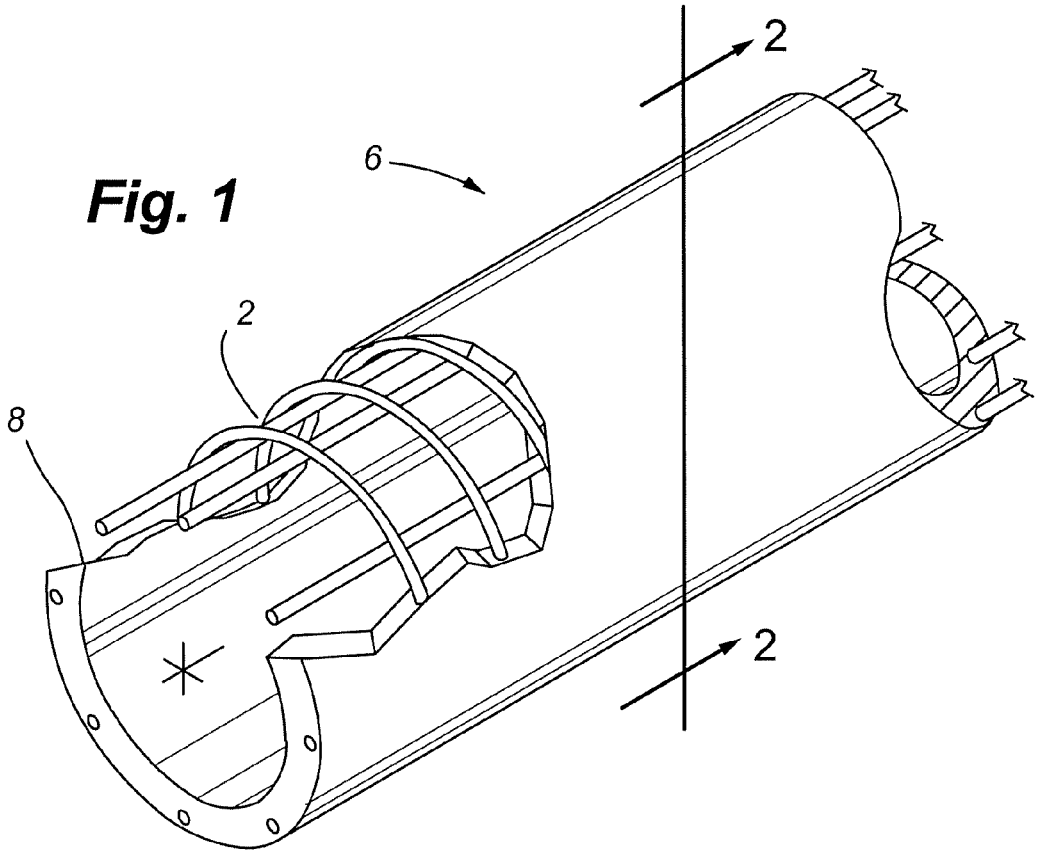
FIG. 1 is a perspective view of a concrete pipe, wherein a portion thereof has been removed to expose the reinforcing frame.

To assist in the understanding of the present invention the following list of components and associated numbering found in the drawings is provided herein:

| Component | # |
|---|---|
| Reinforcing Frame | 2 |
| Integral Spacer | 4 |
| Pipe | 6 |
| Matrix | 8 |
| Longitudinal Member | 10 |
| Transverse Member | 12 |
| Pulling Arm | 14 |
| Drive Mechanism | 16 |
| Support Plate | 18 |
| Vertical Support | 20 |
| Lateral Support | 22 |
| Adjustment Slots | 24 |
| Housing | 26 |
| Screw Jack | 28 |
| Blade | 30 |
| Shaft | 32 |
| Pulling Arm Guides | 34 |
| Crank | 36 |
| Actuator | 38 |

It should be understood that the drawings are not necessarily to scale. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION

Referring now to FIGS. 1–9, device and method for selectively deforming a reinforcing frame 2 to produce integral spacers therein is shown. More specifically, a device that selectively engages and deforms reinforcing members of a frame 2 that is employed in the fabrication of concrete pipes 6 is shown herein. Often, metallic frames 2 are used in the construction of concrete pipes 6 to increase the structural load carrying capabilities thereof. It is desirable to orient the frame 2 in a predetermined location within the concrete matrix 8 to ensure predictable composite material properties. Thus, the present invention deforms the frame at predetermined locations to ensure that the frame remains in place during concrete pipe fabrication.

Figure 2:
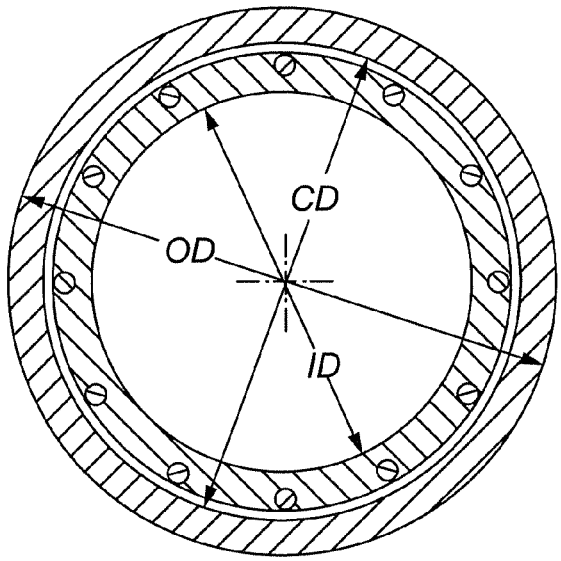
FIG. 2 is a cross section of the concrete pipe of FIG. 1 showing the outer diameter, inner diameter, and frame placement diameter.

Referring now to FIGS. 1–2, a concrete pipe 6 is shown herein. More specifically, pipes 6 of this type are generally constructed of a matrix material 8, such as concrete, which further includes aggregate material, cement, and water, and a reinforcing frame 2. This reinforcing frame 2 includes a plurality of longitudinal members 10 and transverse members 12 that are tied together to form an interconnected frame 2. Generally, construction of the pipe 6 begins by inserting the frame 2 into a form that is adapted to receive concrete that envelops the frame 2. A major drawback of this process is that during placement of the concrete, the frame 2 may be displaced. More specifically, it is desirable to maintain the frame 2 at a predetermined diameter that is between the outside diameter (OD) of the finished pipe 6 and the inside diameter (ID) of the finished pipe 6. If the location of the frame 2 with respect to the OD and ID of the finished pipe 6 is off-center, undesirable structural behavior may occur, such as localized cracking or buckling. Thus, it is desirable and very important to ensure that the frame 2 is maintained in the mold such that the finished product will result in a pipe with the reinforcing members at the optimal locations.

Figure 3:
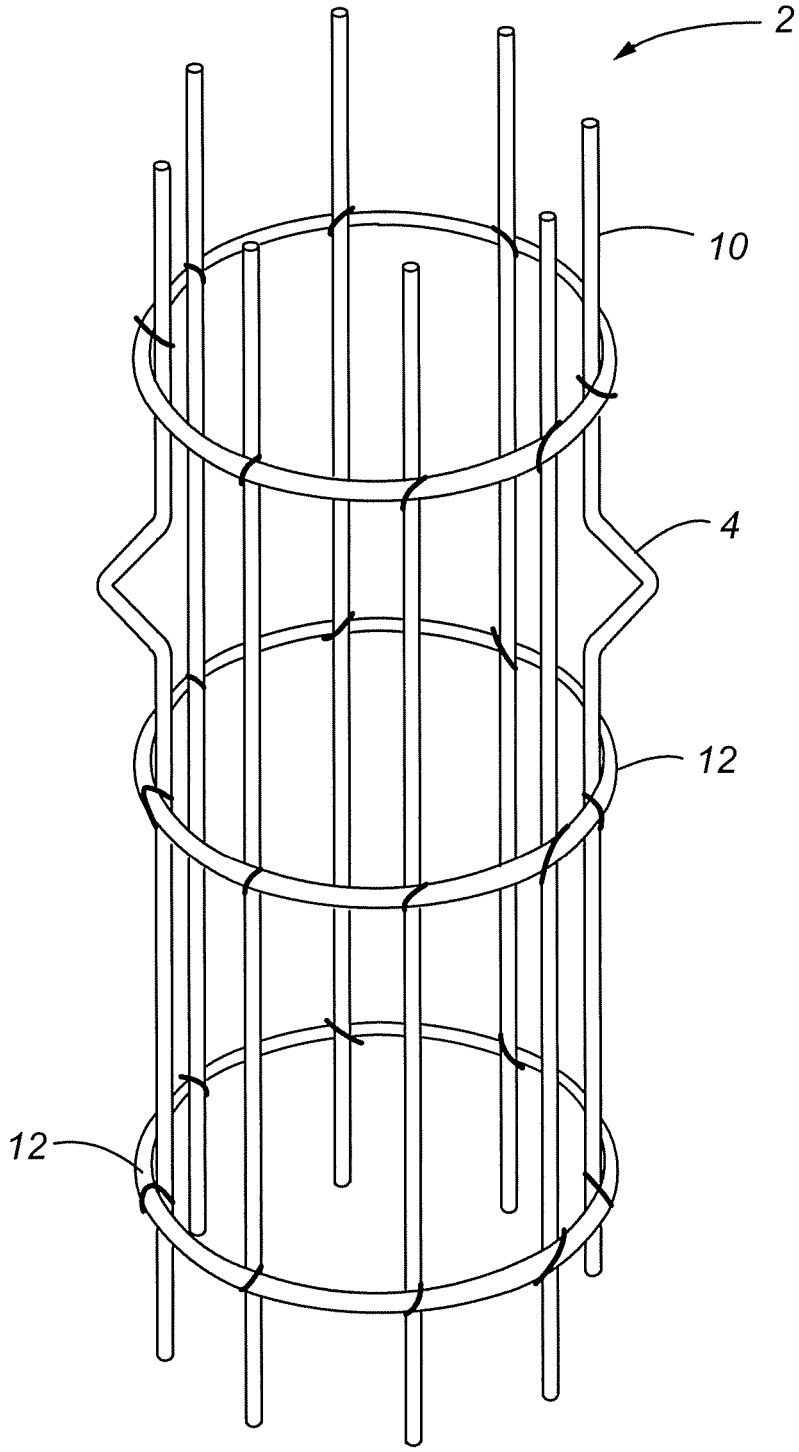
FIG. 3 is a front perspective view of a reinforcing frame that has been selectively deformed to create integral spacers by one embodiment of the present invention.
Figure 4:
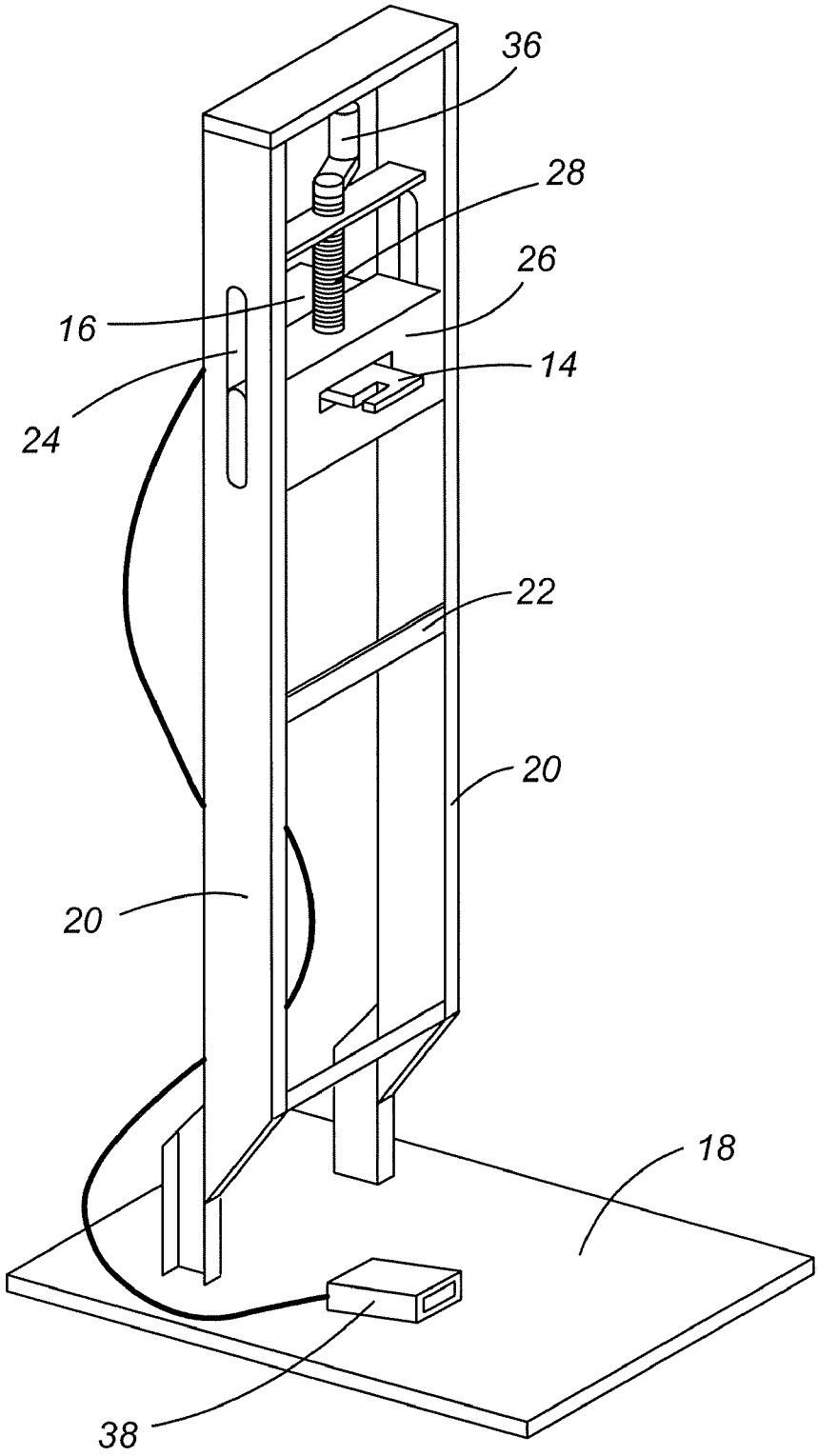
FIG. 4 is a perspective view of one embodiment of the present invention.
Figure 5:
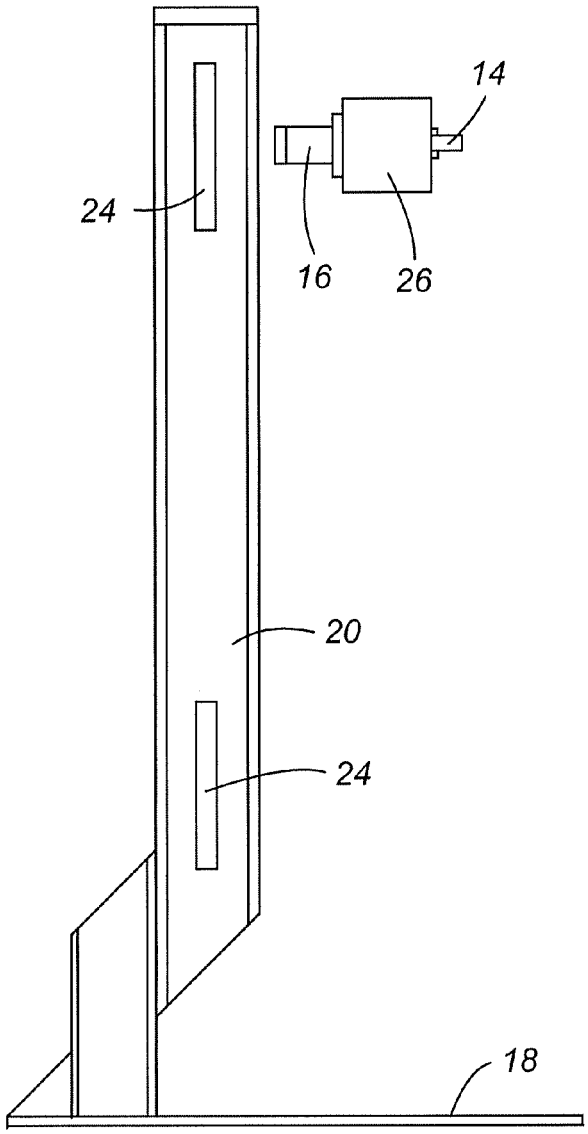
FIG. 5 is a left elevation view of the embodiment of the present invention shown in FIG. 4.
Figure 6:
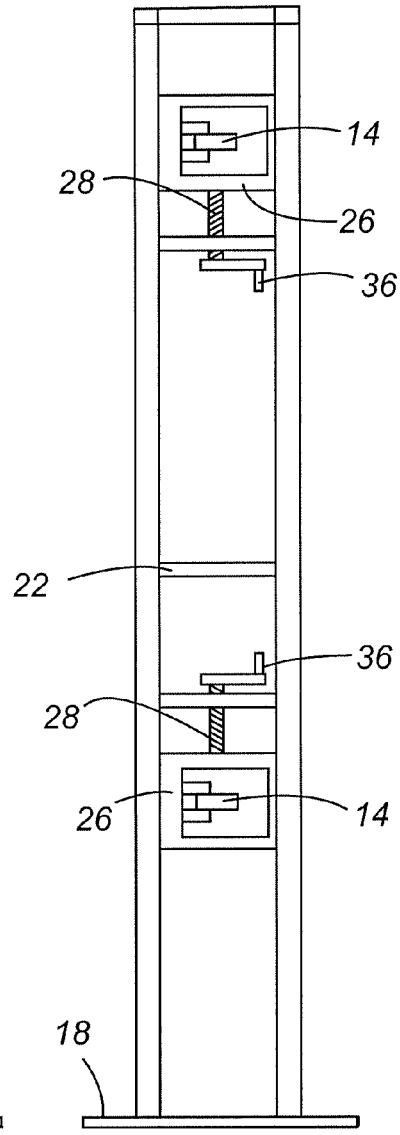
FIG. 6 is a front elevation view of the embodiment of the present invention shown in FIG. 4.

Referring now to FIG. 3, the frame 2 that is employed in the construction of concrete pipes is shown herein. More specifically, the frame 2 is generally constructed of a plurality of longitudinal members 10 and transverse members 12. Here, the frame 2 is defined by circular transverse members 12 with longitudinal members 10 attached thereto at predetermined locations. Other frames 2 employing longitudinal members 10 are tied to square hoops or various other shapes of transverse members 12 to form a frame 2. Since the frame's outside dimension is smaller than the inside diameter of the mold, the frame 2 will be capable of movement within the concrete mold, which potentially causes misalignment of the frame 2 in the finished product. Thus, the present invention provides integral spacers 4 at predetermined locations of the frame 2, for example on the longitudinal members 10. These integral spacers 4 are basically v-shaped crimps in the longitudinal members 10, wherein the diameter of the frame 2 is increased in a localized area. In addition, the integral spacers 4 are adapted to selectively engage the inside diameter of the concrete mold to thus ensure that the majority of the frame 2 is aligned properly therein during the forming process. The number and frequency of integral spacers 4 will depend on the length and complexity of the mold. More specifically, it is envisioned that at least two integral spacers 4 will be used in one embodiment of the present invention to ensure that the frame is aligned properly before and during placement of the concrete matrix within the mold.

Referring now to FIGS. 4–9, a device for selectively deforming the shape of a frame 2 is shown herein. More specifically, a device comprising of a pulling arm 14 that is operably interconnected to a drive mechanism 16 is shown herein. The pulling arm 14 is adapted to selectively engage a portion of a reinforcing frame and deform it to create the integral spacer 4. The drive mechanism 16 may be hydraulic, pneumatic, or electrical and the actuator may be a foot, hand, computer, or signal operated. Preferably, one embodiment of the present invention includes a support plate 18 that is interconnected to two vertical support members 20 that are in turn supported by a plurality of lateral supports 22. Within the vertical supports reside a plurality of adjustment slots 24 that are operably interconnected to a housing 26 wherein the pulling arm 14 resides. The housing 26 is also interconnected to a screwjack 28 that is adapted to selectively adjust the vertical location of the housing 26 to allow greater pulling arm 14 placement options. The housing 26 is interconnected to the adjustment slots 24 by a plurality of connecting mechanisms that allow for easy adjustment but maintain stability of the housing 26 with respect to the vertical supports 20.

In one embodiment of the present invention, the pulling arm 14 includes a blade 30 that is interconnected to a shaft 32 that is interconnected to the drive mechanism 16. As briefly mentioned above, the drive mechanism 16 may be pneumatically, hydraulically, mechanically, or electrically controlled to pull the shaft 32, thus crimping the frame 2. In addition, the pulling arm 14 is flanked by two guide members 34 to ensure that the deformation operation produces the predetermined shape. The guide members 34 are interconnected to the housing 26 that supports and holds the drive mechanism 16, and that provides a location for which to selectively interconnect the apparatus to the vertical supports 20. As shown herein, the height adjustments of the housing 26 of this embodiment of the present invention are performed by screw jacks 28 that are interconnected to cranks 36. The screw jacks 28 of this embodiment allow for discrete vertical motion of the housing 26. In addition, the housings 26 are selectively interconnected to adjustment slots 24 that are generally apertures in the vertical supports 20 of the device. Alternatively, other methods of adjustment may be used and will be appreciated by one skilled in the art. More specifically, tracks may be employed on the vertical supports 20 to provide locations for selective interconnections to the housing 26. The housing 26 would then be moved by cables, chains, or other means to predetermine locations along the length of the vertical supports 20 to perform the deformation operations. In addition, as shown herein, the present invention has been depicted in a vertical position. It should be appreciated by one skilled in the art that a horizontally biased frame deformation device may be constructed, wherein the frame's longitudinal members are oriented parallel to a horizontal surface prior to deformation. In addition, it is envisioned that for a smaller diameter frame members, which are easier to deform, a handheld version of the present invention may be constructed to allow a user to quickly deform the frame.

Referring now to FIGS. 1–9, the method of altering the shape of a reinforcing frame 2 is shown and described herein. In one embodiment of the present invention the device adapted to selectively alter the shape of a frame is vertically opposed, wherein the housing 26 is adapted to move in an axis perpendicular to a horizontal plane. To perform a deformation operation thus creating an integral spacer 4, the user initially moves the frame 2 into position near the pulling arm 14. More specifically, the frame is placed such that the longitudinal members 10 are vertically oriented and the bottom of the frame 2 is placed on the support plate 18 of the device. Next, one of the longitudinal members 10 is rotated into the blade area 30 of the pulling arm 14. The actuator 38 is the activated, thus sending a signal that is either pneumatic, hydraulic, or electrical to the drive mechanism 16 to initiate movement of the pulling arm 14 into the housing 26, thereby pulling the longitudinal member 10 of the frame 2. Once this process is completed, that is the localized diameter of the frame 2 is altered to a predetermined amount, the drive mechanism 16 is released wherein the frame 2 may be rotated or the housing moved to another location to create additional integral spacers 4.

While various embodiment of the present invention have been described in detail, it is apparent that modifications and adaptations of those embodiments will occur to those skilled in the art. However, it is to be expressly understood that such modifications and adaptations are within the scope and spirit of the present invention, as set forth in the following claims.

What is claimed is:

1. A method for creating an integral spacer in a metallic frame for reinforced concrete pipe, comprising the steps of:

providing a substantially cylindrical shaped metallic frame comprising a plurality of longitudinally oriented reinforcing members and a plurality of transversely oriented reinforcing members to define a first length and a first diameter;

providing a deforming apparatus comprising a pulling arm interconnected to a drive mechanism that is interconnected to a housing, which is selectively interconnected to a support;

positioning at least one of said longitudinally oriented reinforcing members proximate to said pulling arm;

securing said at least one longitudinally oriented reinforcing member to said pulling arm; and pulling said longitudinally oriented reinforcing member in a direction substantially away from said cylindrical shaped metal frame with sufficient force to permanently deform said at least one of said longitudinally oriented reinforcing member, wherein said substantially cylindrical shaped metal frame has a greater diameter at the location where said longitudinally oriented reinforcing member has been deformed.

2. The method of claim 1, wherein said pulling arm is operated with at least one of a hydraulic pressure, a pneumatic pressure, and an electrical motor.

3. The method of claim 1, wherein said pulling arm has a cut-out portion operatively shaped to receive said longitudinally oriented reinforcing member.

4. The method of claim 1, wherein said support is a vertical metallic frame having a length at least about equivalent to said first length of said substantially cylindrical shaped metallic frame.

5. The method of claim 1, wherein said pulling step is selectively controlled with a foot activated valve.

6. The method of claim 1, wherein said at least one vertically oriented reinforcing member is deflected at least about 0.5 inches.

7. The method of claim 1, wherein said pulling step is performed on at least two of said vertically oriented reinforcing members positioned on substantially opposite sides of said substantially cylindrical shaped metallic frame.

8. The method of claim 1, wherein said pulling step exerts a force of at least about 200 lbs.

9. The method of claim 1, wherein said pulling arm may be selectively positioned at a plurality of positions on said support.

* * * * *